US007967553B2

(12) United States Patent
Wagner

(10) Patent No.: US 7,967,553 B2
(45) Date of Patent: Jun. 28, 2011

(54) PUMP WITH CUTTING IMPELLER

(75) Inventor: Peter Wagner, Werdohl (DE)

(73) Assignee: Brinkmann Pumpen K.H. Brinkmann GmbH & Co. KG, Werdohl (DE)

( * ) Notice: Subject to any disclaimer, the term of this patent is extended or adjusted under 35 U.S.C. 154(b) by 890 days.

(21) Appl. No.: 11/720,628

(22) PCT Filed: Nov. 11, 2005

(86) PCT No.: PCT/EP2005/012123

§ 371 (c)(1),
(2), (4) Date: Nov. 19, 2007

(87) PCT Pub. No.: WO2006/058605

PCT Pub. Date: Jun. 8, 2006

(65) Prior Publication Data

US 2009/0092479 A1 Apr. 9, 2009

(30) Foreign Application Priority Data

Dec. 3, 2004 (DE) ..... 10 2004 058 458
Feb. 10, 2005 (DE) ..... 20 2005 002 084

(51) Int. Cl.
*F04D 29/70* (2006.01)

(52) U.S. Cl. ..... 415/121.1; 415/169.1; 416/198 R

(58) Field of Classification Search ..... 415/121.1, 415/121.2, 175, 203, 198 R
See application file for complete search history.

(56) References Cited

U.S. PATENT DOCUMENTS

| | | | | |
|---|---|---|---|---|
| 2,027,015 | A | 1/1936 | Bell | |
| 3,692,422 | A | 9/1972 | Girardier | |
| 5,460,483 | A | 10/1995 | Dorsch | |
| 6,190,121 | B1 * | 2/2001 | Hayward et al. | 415/121.1 |
| 6,224,331 | B1 | 5/2001 | Hayward et al. | |
| 6,406,635 | B1 | 6/2002 | Smith et al. | |
| 2002/0146319 | A1 | 10/2002 | Dorsch et al. | |

FOREIGN PATENT DOCUMENTS

| | | | |
|---|---|---|---|
| DE | 1806195 | | 7/1970 |
| DE | 3640813 | A1 * | 11/1987 |
| DE | 4438841 | C1 | 2/1996 |
| DE | 19804907 | C1 | 7/1999 |
| EP | 0013942 | A | 8/1980 |
| EP | 0774045 | B1 | 12/2002 |
| GB | 1299846 | | 12/1972 |

* cited by examiner

*Primary Examiner* — Edward Look
*Assistant Examiner* — Dwayne J White
(74) *Attorney, Agent, or Firm* — Richard M. Goldberg

(57) ABSTRACT

A pump having an axial impeller (40) with helical blades (38) for sucking liquid through an intake opening (38) formed at a bottom side of the axial impeller (40), in which the blades (38) are provided, at the bottom side of the axial impeller (40), with a first cutting edge (58) which, when the axial impeller (40) rotates, are in cutting relation with at least one second cutting edge (60) formed at the intake opening (36).

9 Claims, 2 Drawing Sheets

PUMP WITH CUTTING IMPELLER

BACKGROUND OF THE INVENTION

The invention relates to a pump having an axial impeller with helical blades for sucking liquid through an intake opening that is arranged at a bottom side of the axial impeller.

A pump of this type has been described in DE 198 04 907 C1.

DE 1 806 195 B and U.S. Pat. No. 2,027,015 disclose pumps having a cutting axial impeller the blades of which are arranged to be in cutting relation, at the periphery of the axial impeller, with cutting edges formed at a wall of an intake-side pump housing or of an intake tube, respectively.

U.S. Pat. No. 6,406,635 B1 discloses a method for pumping cooling and lubricating liquids that are contaminated with metal chippings.

The invention is particularly concerned with a pump that is arranged at a base of a machine tool and serves for pumping cooling liquid for the machine tool, which is collected in a liquid reservoir in the machine base, so that the liquid may again be supplied to the machining tool, possibly with the aid of another pump. For that purpose, radial-type rotary pumps with open impeller blades have been proved to be particularly suitable, because they are relatively insensitive to articles such as chippings or the like that may be contained in the cooling liquid.

In the past years, machine tools have increasingly been used for machining light metal, such as aluminum, for example in automotive industry. The chippings that are created in machining of light metal may reach a considerable length.

SUMMARY OF THE INVENTION

It is therefore an object of the invention to provide a pump that is capable of reliably and efficiently pumping cooling liquids that are contaminated with light metal chippings.

According to the invention, this object is achieved by a pump of the type indicated above, wherein the impeller blades are provided, at the bottom side of the axial impeller with a first cutting edge that, when the axial impeller rotates, is in cutting relation with at least one second cutting edge formed at the intake opening.

Thus, the axial impeller has two functions: It sucks the liquid into the pump and at the same time cuts or chops chippings -or other contaminants that may be contained in the liquid, with the cutting edges formed on the bottom side of the impeller. In comparison to a pump that is provided with an external chopper, a higher pump efficiency is achieved. Moreover, in particular in an arrangement in which the axis of the impeller is arranged vertically and the intake opening faces downwardly, the axial impeller has a high suction and slurping efficiency, for example, when the intake opening serving as a suction opening is approximately at the same height as the level of the liquid in the reservoir. The axial impeller reliably conveys the material into a downstream pump chamber, for example, without exposing the liquid to disturbing centrifugal forces. The axial impeller has the additional advantage that it permits large intake passages, which contributes to an improved performance of the pump.

Useful embodiments of the invention are indicated in the dependent claims.

Preferably, the at least one second cutting edge that is provided at the intake opening of the pump is formed on a finger that projects radially into the intake opening. Then, for example, a hub portion of the axial impeller may be readily accessible.

Preferably, the at least one second cutting edge formed at the intake opening of the pump and the first cutting edge of the at least one impeller blade are arranged to cooperate like a pair of scissors. It is particularly preferred that the cutting edges are formed such that, when the axial impeller rotates, the scissors action between the first and second cutting edges meeting each other proceeds essentially radially from the inside towards the outside. In case of a first cutting edge extending essentially in radial direction, this can be achieved for example by arranging the second cutting edge so as to deviate from the radial direction in the direction of rotation of the axial impeller. For example, this cutting edge may be curved in a spiral shape.

Preferably, the first cutting edges of the impeller blades are formed on a cutting surface of the axial impeller, which cutting surface encompasses an annular hub portion of the axial impeller, and the second cutting edge extends radially inwardly at least up to hub portion. Then, for example, the first cutting edge extends beyond the outer periphery of the intake opening. As a result, the cutting surface having the first cutting edges cooperates with the second cutting edge and the outer peripheral edge of the intake opening in such a manner that, during the cutting operation, a window is formed and is closed gradually. This assures that longer chippings are sectioned reliably, so that the length of the chipping sections entering into the pump is limited to a certain size.

In a preferred embodiment, the pump is a centrifugal pump and has a pump chamber with an intake tube accommodating the axial impeller, and the pump chamber further accommodates, in an axially offset position, another impeller or a portion of the axial impeller that projects radially and is equipped with radial blades and serves a radial impeller arranged downstream of the axial impeller. A combination of an axial impeller and a radial impeller permits to achieve a particularly high pump throughput, combined with a high suction or slurping efficiency, thanks to the axial impeller.

In accordance with a further development of the invention, at least one of the first and second cutting edges is provided with teeth. Preferably, the first cutting edge is provided with teeth.

The pump according to the invention is suitable for a method for pumping cooling and lubricating liquids that are contaminated with metal chippings, wherein the metal chippings are chopped by the cutting edges during the pump operation.

BRIEF DESCRIPTION OF THE DRAWINGS

Preferred embodiments of the invention will now be described in conjunction with the drawings, wherein.

DETAILED DESCRIPTION

Figure 1:
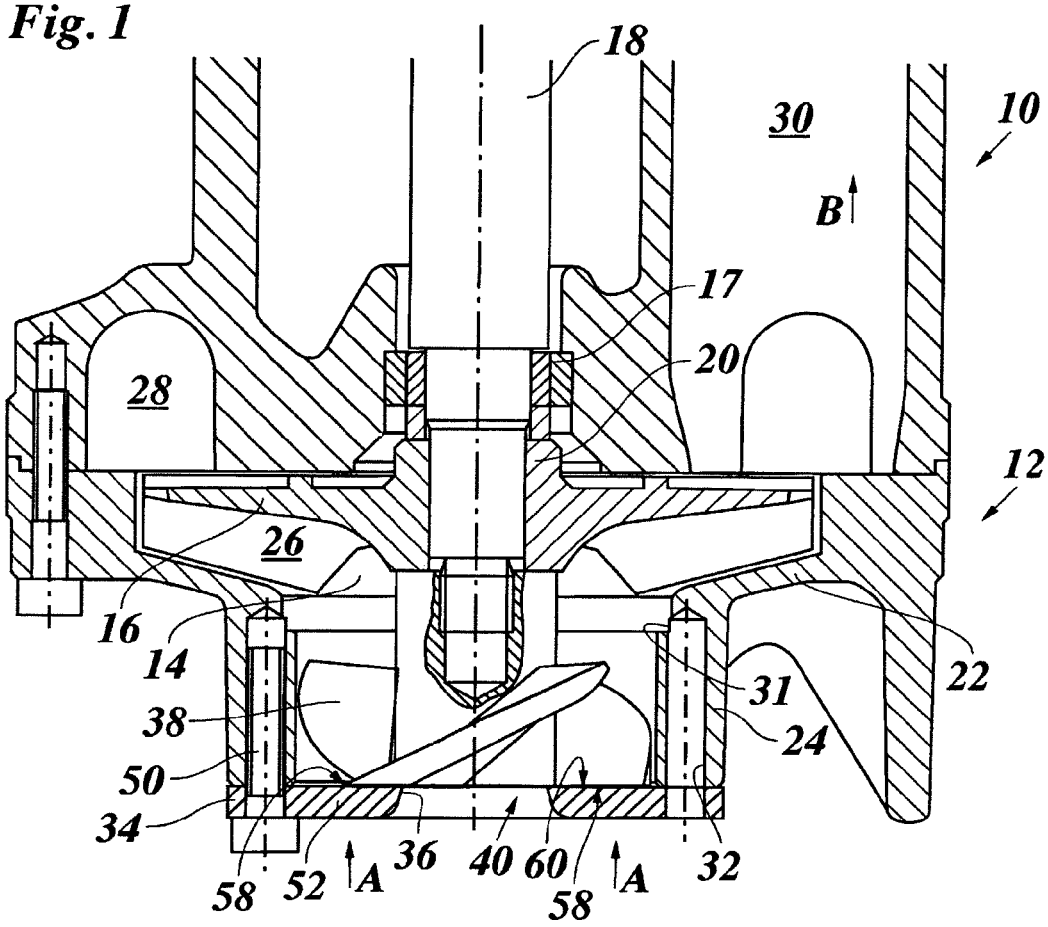
FIG. 1 is an axial section of a centrifugal pump according to the invention.

The centrifugal pump shown in FIG. 1 has an essentially cylindrical housing 10 with a head 12 flanged to the lower end thereof, and this head plunges into a liquid reservoir, that has not been shown, in a base of a machine tool. The head 12 forms a pump chamber 14 which accommodates a radial impeller 16. In the housing 10, a shaft 18 is coaxially supported in a bearing 17, and the top end of the shaft is connected to a drive motor that has not been shown and is supported in fixed bearings that have not been shown. These bearings determine the axial position of the shaft 18. A hub 20 of the impeller 16 is keyed onto the lower end of the shaft 18. A wall 22 of the head 12, which forms the lower part of the pump chamber 14, forms a downwardly projecting intake tube 24 coaxial with the impeller 16 and the shaft 18.

The impeller 16 is a semi-open impeller equipped with downwardly open blades 26. These blades are inclined such that the liquid present in the intake tube 24 is sucked-in and is conveyed radially outwardly into a ring chamber 28 above the outer periphery of the pump chamber 14. Thanks to the liquid pressure that is created in the ring chamber 18 in this way, the liquid flows upwardly in the direction of arrow B through a rising channel 30 formed in the housing 10 and towards a pump outlet port that has not been shown.

At the internal peripheral wall of the intake tube 24, openings 31 connect the pump chamber 14 to a number of vent channels 32 that are distributed in circumferential direction. An intake plate 34 is arranged at the lower end of the intake tube 24, and the vent channels 32 are open to the bottom side of the intake plate. The intake plate 34 closes-off the pump chamber 14 at the bottom side and has an intake opening 36.

An axial impeller 40 which is shown only partly in section in FIG. 1 and is equipped with helical blades 38 is arranged on an extension of the shaft 18 inside of the intake tube 24. The axial impeller 40 conveys the liquid in direction of arrow A from the lower end of the intake tube 24 through the intake opening 36 and axially upwards into the inner portion of the pump chamber 14. In this way, the throughput of the pump is increased significantly.

Figure 2:
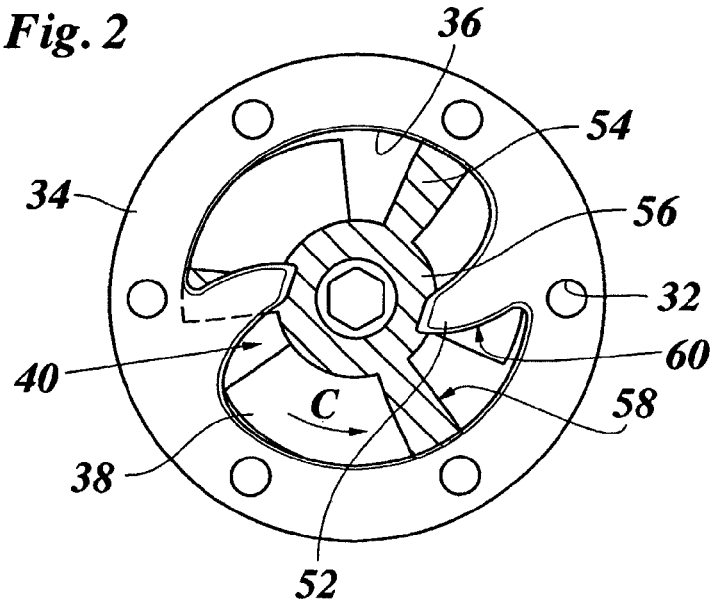
FIG. 2 is a plan view of an intake opening of the centrifugal pump.

FIG. 2 is a view as seen from the bottom side in FIG. 1 and shows the intake plate 34 and the axial impeller 40 with three blades 38 arranged behind the intake plate. The openings of six vent channels 32 have been shown. However, three of these vent channels 32 are blocked by bolts 50 (FIG. 1) with which the intake plate 34 is fixed to the head 12.

The intake plate 34 has an essentially annular shape with two fingers 52 projecting radially inwardly into the intake opening 36. The fingers 52 are bent in spiral shape, and, from the inside to the outside, they increasingly deviate from the radial direction in the direction of the rotation of the impeller (arrow C). At the bottom side, the edges of the intake opening 36 are rounded-off, as can best be seen in FIG. 1 where the fingers 52 are shown in the section.

In FIG. 2 one recognizes the bottom side of the axial impeller 40 which forms a cutting surface 54 that has been hatched in the drawing. The cutting surface 54 extends over the bottom sides of the blades 38 and over an annular hub portion 56. At each blade 38, the cutting surface 54 forms a first cutting edge 58 which cooperates with second cutting edges 60 formed at the fingers 52. Since the first cutting edges 58 extend essentially in radial direction, whereas the second cutting edges 60 spiral away from the radial direction in the direction of rotation of the impeller, the first and second cutting edges 58 and 60 cooperate like a pair of scissors when the axial impeller 40 rotates. The scissors action starts between first and second cutting edges meeting each other and then proceeds radially from the inside to the outside. In the outer portion, the second cutting edges 60, however, are curved in a direction opposite to the direction of rotation of the axial impeller 40 (arrow C).

The first cutting edges 58 extend along the fingers 52 radially outwardly beyond a maximum aperture radius of the intake opening 36, as has been indicated in phantom lines in FIG. 2. The second cutting edges 60 extend inwardly up to the hub portion 56. Thus, each time a first cutting edge 58 moves towards a second cutting edge 60, the edges of the intake opening 36 and the cutting surface 54 define a window which is closed completely during the cutting operation. This assures that long chippings are sectioned reliably.

The portions of the blades 38 and the fingers 52 forming the first and second cutting edges 58, 60 are formed for example of hardened steel with a Rockwell hardness of 60 HRC. The hardness and the axial spacing between the first cutting edges 58 and the second cutting edges 60 have to be determined in accordance with the purpose for which the pump is to be used. It is also possible that the cutting surface 54 slides over the intake plate 34. The axial spacing between the first and second cutting edges 58, 60 can be adjusted and varied by means of spacer sheets. For example, the spacer sheets are inserted from the outside between the intake plate 34 and the head 12, so that the distance between the intake plate 34 and the cutting surface 54 is changed.

Figure 3:
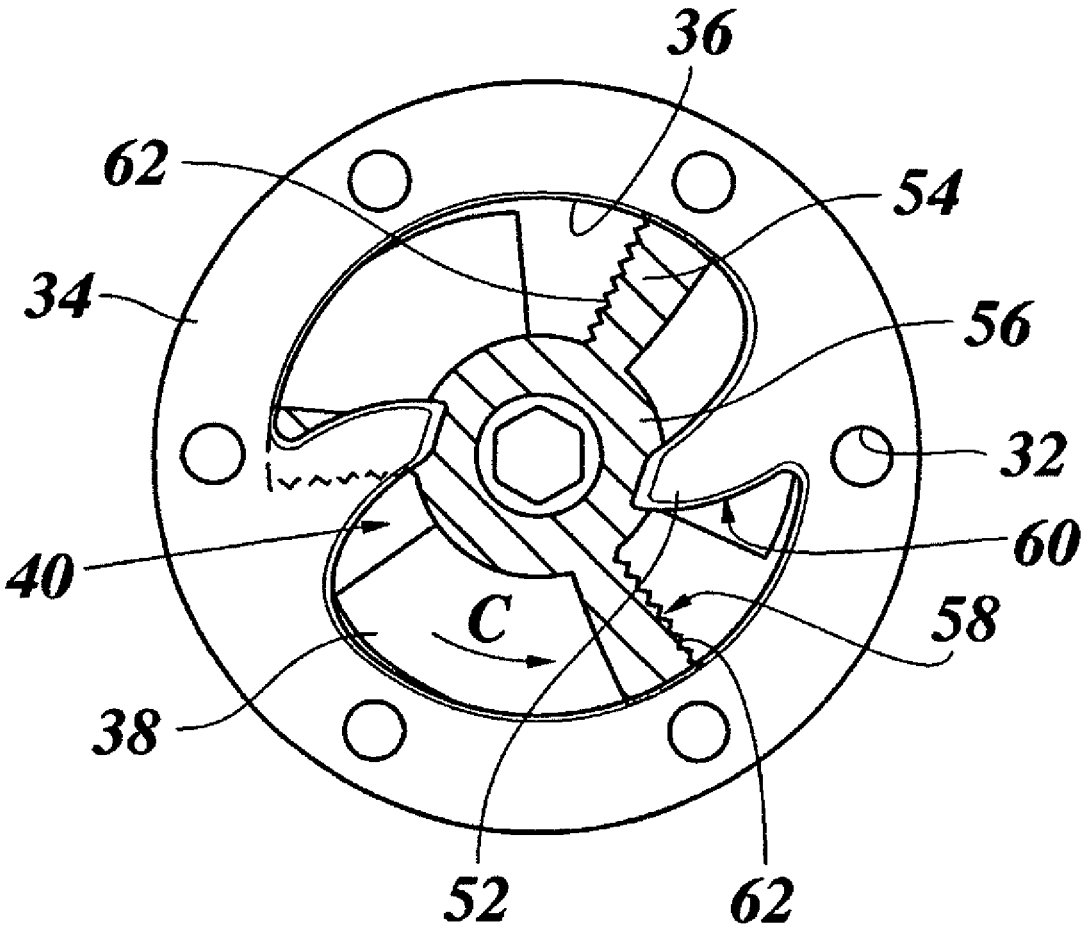
FIG. 3 is a plan view of an intake opening of a centrifugal pump according to another embodiment.

The embodiment example shown in FIG. 3 corresponds essentially to the example shown in FIGS. 1 and 2. However, the cutting edges 58 of the cutting surface 54 of the blades 38 are formed with saw-like teeth 62 which assure that any chippings will be gripped by the teeth 62 and will be taken along during the cutting operation and will then be cut. This prevents the chippings from drifting radially outwardly along a cutting edge, for example, when the window formed by the edges of the intake opening 36 and the cutting surface 54 is closed.

Thus, the teeth 62 result in a more even load on the cutting edges 58 and 60, and they also increase the efficiency of the cutting edges 58 and 60.

As an alternative or in addition, teeth may also be provided at the cutting edges 60 of the fingers 52.

Differing from the embodiment examples that have been described, the intake plate 34 may for example be attached to the head 12 at additional screw-bores or in any other way.

In the examples shown, the axial impeller 40 is mounted on the shaft 18 below the radial impeller 16. However, it is also possible to provide a separate drive train for the impeller 40. On the other hand, the impeller 40 may also be formed in one piece with the radial impeller 16.

The ring chamber 28 which is arranged above the radial ends of the blades 26 of the impeller 16 in FIG. 1, may alternatively be arranged around the periphery of the impeller 16.

Moreover, while the shown examples relate to a single-stage centrifugal pump with only one radial impeller 16, the invention is also applicable to multi-stage centrifugal pumps. Likewise, the Invention Is applicable to pumps having only one or more axial impellers.

Of course, other embodiments of the cutting edges 58, 60 and the intake plate 34 are also possible. For example, the two curved fingers 52 might be replaced with a bar passing through the hub portion 56.

The invention claimed is:

1. A pump comprising:

an axial impeller with helical blades for sucking liquid through an intake opening formed at a bottom side of the axial impeller, the blades being provided, at the bottom side of the axial impeller, with a first cutting edge, and at least one second cutting edge formed at the intake opening which, when the axial impeller rotates, are in cutting relation with the first cutting edge, wherein the second cutting edge arranged at the intake opening of the pump deviates from a radial direction of the axial impeller in a direction of rotation.

2. Pump according to claim 1, wherein the at least one second cutting edge formed at the intake opening of the pump is formed on a finger projecting radially into the intake opening.

3. Pump according to claim 1, wherein the at least one second cutting edge formed at the intake opening of the pump and the first cutting edge of at least one said blade are arranged to cooperate like a pair of scissors.

4. Pump according to claim 3, wherein the cutting edges are arranged such that, when the axial impeller rotates, the scissors action between the first and second cutting edges meeting each other proceeds essentially radially outwardly.

5. Pump according to claim 1, wherein:

the first cutting edges of the blades at the bottom side of the axial impeller are formed at a cutting surface which encompasses an annular hub portion of the axial impeller, and the second cutting edge extends radially inwardly at least up to the hub portion.

6. Pump according to claim 1, wherein the pump is a centrifugal pump, and includes a pump chamber having an intake tube accommodating the axial impeller, the pump chamber accommodating, in a position displaced in an axial direction of the pump, one of:

another impeller, and a part of the axial impeller equipped with radial blades, forming a radial impeller arranged downstream of the axial impeller.

7. Pump according to claim 1, wherein at least one of the first and second cutting edges has teeth.

8. Pump according to claim 7, wherein the first cutting edge has the teeth.

9. Method for pumping cooling and lubricating liquids that are contaminated with metal chippings with a pump according to claim 1, comprising the step of, during pumping, chopping the metal chippings by the cutting edges at the bottom side of the axial impeller when entering into the intake opening.

* * * * *